United States Patent [19]

Allan

[11] 4,039,360

[45] Aug. 2, 1977

[54] GELLED MONOMETHYLHYDRAZINE THIXOTROPIC FUEL

[75] Inventor: Barry D. Allan, Huntsville, Ala.

[73] Assignee: The United States of America as represented by the Secretary of the Army, Washington, D.C.

[21] Appl. No.: 179,217

[22] Filed: Sept. 9, 1971

Related U.S. Application Data

[63] Continuation-in-part of Ser. No. 518,489, Jan. 3, 1966, Pat. No. 3,857,743.

[51] Int. Cl.[2] ..... C06B 47/08

[52] U.S. Cl. ..... 149/36

[58] Field of Search ..... 149/36

[56] References Cited

U.S. PATENT DOCUMENTS

| | | | |
|---|---|---|---|
| 3,301,721 | 1/1967 | McCoy et al. | 149/36 X |
| 3,552,126 | 1/1971 | Ahlert et al. | 149/36 X |
| 3,650,855 | 3/1972 | MacKenzie | 149/87 |
| 3,650,857 | 3/1972 | Burdette et al. | 149/36 |

OTHER PUBLICATIONS

Audrieth, et al., The Chemistry of Hydrazine, pp. 6–9, 197, 200, 204–207, 209 and 210, John Wiley & Sons, Inc., (1951), New York.

*Primary Examiner*—Edward A. Miller
*Attorney, Agent, or Firm*—Nathan Edelberg; Robert P. Gibson; James T. Deaton

[57] ABSTRACT

A thixotropic rocket fuel composed of monomethylhydrazine, metallic fuel particles, dimethylurea, and a gellant. The particular thixotropic fuel is particularly characterized by the fact that a low gellant concentration can be used and by the fact that the metallic fuel particles can be suspended with no separation or settling out of the metallic fuel particles in the fuel even when subjected to 500 g's. The particular thixotropic rocket fuel has high density quality and high specific impulse values.

3 Claims, No Drawings

GELLED MONOMETHYLHYDRAZINE THIXOTROPIC FUEL

CROSS-REFERENCE TO RELATED APPLICATION

This invention is a continuation-in-part and an improvement over the invention disclosed in the copending application of Barry D. Allan, Ser. No. 518,489, filed Jan. 3, 1966, and now U.S. Pat. No. 3,857,743.

BACKGROUND OF THE INVENTION

For applications where fuel tank volume is limited, it is desirale to increase the density of the fuel while maintaining a high specific impulse. One means of increasing the density of the fuel is to suspend finely divided particles of a metal in the fuel. An approach to suspend the metal fuel particles in the fuel has been difficult because of the necessity of maintaining the particles in suspension at high g-loadings. While applicant's previous invention has suspension capabilities, the suspensions have required high concentrations of gellant. Also, the high concentrations of gellant takes up space and therefore, a composition is needed in which a lower percentage of gellant can be used and still maintain the metal particles suspended in the fuel even at very high g-loadings.

Therefore, it is an object of this invention to provide a thixotropic fuel which has a relatively low gellant concentration.

Another object of this invention is to provide a thixotropic fuel which has the ability even with low gellant concentration to maintain metallic fuel particles dispersed therein even under several hundred g's loading.

A further object of this invention is to provide a thixotropic fuel in which the density is relatively high and the specific impulse is also high.

SUMMARY OF THE INVENTION

In accordance with this invention, a novel thixotropic fuel is disclosed that includes the fuel monomethylhydrazine in an amount of about 36 to about 40 weight percent, a gellant such as any cellulose of hydroxyalkyl-substituted gelling agent in an amount of about 1 to about 3 weight percent, an additive of dimethylurea in an amount of about 0.05 to about 0.3 weight percent, and metallic fuel particles in an amount up to about 60 weight percent. This particular composition produces a thixotropic fuel that is capable of maintaining the metallic fuel particles in suspension even under very high g-loadings which is required for rocket fuel. Also, the metallic fuel particles are maintained in suspension even though the percentage of gellant and the additive are very small in quantity. The percentage of metallic fuel particles may be even greater than 60 weight percent if the g-loading requirement is lowered.

DETAILED DESCRIPTION OF THE INVENTION

This invention is a thixotropic rocket fuel and more particularly a gelled monomethylhydrazine (MMH) containing metallic fuel particles. For applications where fuel-tank volume is limited, it is desirable to increase the density of the fuel while maintaining a high specific impulse. One means of increasing the density of the fuel is to suspend finely divided particles of a metal in the MMH.

Such an approach has been difficult because of the necessity of maintaining the particles in suspension at high g-loadings. As disclosed in applicant's copending application Ser. No. 518,489, filed Jan. 3, 1966, stablized suspensions have used higher concentrations of gellant. Also, the particular composition under discussion here uses an additional component to that of applicant's prior invention. The additional component allows lower gellant concentration while maintaining the ability of the gel to show no separation or settling of the fuel after 30 minutes exposure to 500 g's of force. The lower gellant concentration and additional component imparts a lower yield value to this fuel composition as measured by the rising sphere rheometer.

The preferred gellant is hydroxypropyl cellulose containing about 4.6 propoxyl groups per glucose unit (Klucel). However, other cellulose or hydroxyalkyl-substituted gelling agents may be employed such as: hydroxy methyl cellulose containing 27.5 to 31.5 weight per cent methoxyl groups (Methocel); hydroxypropyl methyl cellulose containing 28 to 30 weight per cent methoxyl groups and 7 to 12 weight per cent propoxyl groups (Methocel HG-60); hydroxypropyl methyl cellulose containing 19 to 24 weight per cent methoxyl groups and 4 to 12 weight per cent propoxyl groups (Methocel HG-90); and dihydroxyethyl cellulose (Cellosize).

The term "metallic fuel particles" as used herein is intended to refer to any of the finely divided metals and metal hydrides previously used as fuel in solid propellants. Aluminum, boron, beryllium, lead and zirconium and hydrides of each of these metals can be used. The metallic particles must be finely divided in order to remain in suspension and allow pumping of the gel as a liquid, and very fine, generally spherical particles on the order of 6 to 10 microns in diameter are preferred. Platelet-type particles, for example, rectangular shapes 40 by 25 by .7 to .8 microns in size may also be used.

It has been discovered that MMH of about 36 to about 40 weight percent and about 60 weight percent metallic fuel particles such as preferrably aluminum, can be successfully gelled to such an extent as to hold the metallic fuel particles in suspension under high g-loading by using about 1 to about 3 weight percent gellant of Klucel and about 0.05 to 0.3 weight percent dimethylurea. This particular composition is especially adapted for rocket fuel since it contains such a high concentration of the monopropellant fuel and the metal suspended therein, and since the metallic particles can be maintained suspended even under very high g-loadings such as the 500 g's as stated supra. A particularly perferred thixotropic fuel composition is set forth in the example below:

EXAMPLE

| | | |
|---|---|---|
| gellant - Klucel | 1.4 | % by weight |
| additive - Dimethylurea | .1 | % by weight |
| metal - Aluminum | 60.0 | % by weight |
| Monomethylhydrazine | 38.5 | % by weight |

Metal-containing MMH gel can be prepared by mixing the metallic particles, the gelling agent, and the additive dimethylurea with the MMH in a conventional mixer. The gelling agent Klucel and the dimethylurea are finely divided powders which disperse readily in the MMH.

I claim:

1. A composition consisting of monomethylhydrazine present in an amount of about 36 to about 40 weight percent, hydroxyalkyl cellulose present in an amount of about 1 to about 3 weight percent, metallic fuel particles, and dimethylurea present in an amount of about 0.05 to about 0.03 weight percent to form a gelled fuel.

2. The composition of claim 1, wherein said hydroxyalkyl cellulose is hydroxypropyl cellulose, and wherein the remainder is composed of said metallic fuel particles, said metallic fuel particles being selected from the group consisting of aluminum, magnesium, boron, beryllium, lead zirconium, aluminum hydride, magnesium hydride, boron hydride, beryllium hydride, lead hydride and zirconium hydride.

3. The composition of claim 1, wherein said monomethylhydrazine is present in an amount of about 38.5 weight percent, wherein said metallic fuel particles are aluminum and are present in an amount of about 60 weight percent, wherein said hydroxyalkyl cellulose is hydroxypropyl cellulose and is present in an amount of about 1.4 weight percent, and wherein said dimethylurea is present in an amount of about 0.1 weight percent.

* * * * *